US007678521B2

(12) United States Patent
Kimura et al.

(10) Patent No.: US 7,678,521 B2
(45) Date of Patent: Mar. 16, 2010

(54) ELECTROPHOTOGRAPHIC TONER AND IMAGE FORMING APPARATUS

(75) Inventors: Akiko Kimura, Kanagawa (JP); Yasushige Nakamura, Kanagawa (JP); Shinichi Yaoi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 636 days.

(21) Appl. No.: 11/595,993

(22) Filed: Nov. 13, 2006

(65) Prior Publication Data

US 2007/0287089 A1 Dec. 13, 2007

(30) Foreign Application Priority Data

Jun. 9, 2006 (JP) ..... 2006-161427

(51) Int. Cl.
*G03G 9/00* (2006.01)

(52) U.S. Cl. ..... 430/108.2; 430/108.24; 430/108.4; 430/108.5; 430/124.4; 399/252

(58) Field of Classification Search ..... 430/108.2, 430/108.24, 108.4, 108.5, 124.4; 399/252
See application file for complete search history.

(56) References Cited

U.S. PATENT DOCUMENTS

2003/0203302 A1* 10/2003 Kanamaru et al. ..... 430/108.2

FOREIGN PATENT DOCUMENTS

JP A 6-161155 6/1994

* cited by examiner

*Primary Examiner*—Mark A Chapman
(74) *Attorney, Agent, or Firm*—Oliff & Berridge, PLC

(57) ABSTRACT

There are disclosed an electrophotographic toner including a compound represented by formula (1) and a compound represented by formula (2).

Formula (1)

Formula (2)

In Formula (1), $R_1$, $R_2$, $R_3$, and $R_4$ each independently represent a hydrogen atom, an alkyl group or an aromatic group, and $X^-$ represents a molybdate anion or a tungstate anion. In Formula (2), $R_5^+$ and $R_6^+$ each independently represent a hydrogen ion, an ammonium ion, an iminium ion, or a phosphonium ion, and $R^7$, $R^8$, $R^9$, $R^{10}$, $R^{11}$, $R^{12}$, $R^{13}$, and $R^{14}$ each independently represent a hydrogen atom or an alkyl group.

19 Claims, 1 Drawing Sheet

ELECTROPHOTOGRAPHIC TONER AND IMAGE FORMING APPARATUS

BACKGROUND

1. Technical Field

The present invention relates to an electrophotographic toner for use in forming images by electrophotography, electrostatic printing or the like and to an image forming apparatus using the electrophotographic toner.

2. Related Art

In order to stabilize charge and fixation, a variety of compounds are added to toners for use in electrophotography. For example, the basic composition of two-component type electrophotographic toners is: 80 to 90% by mass of binder resin; about 3 to 15% by mass of pigments; about 1 to 5% by mass of charge control agents; about 1 to 5% by mass of release agents, and if necessary, external additives are added for the purpose of improving fluidity or the like. Electrophotographic toners with the desired performance can be obtained by appropriately changing the composition.

Among image forming apparatuses based on electrophotography, super-high-speed printers or the like often use an α-Si photoreceptor, in terms of the relationship between long life and proper charge transfer. However, the α-Si photoreceptor can provide unstable latent images and poor surface potential retention due to its high charge-transfer rate so that it can be difficult to establish good conditions under which reproducibility of high resolution dots, background fogging and image uniformity may be simultaneously at satisfactory levels and that significant problems with fogging, reproducibility of high definition dots and the margin of long term durability of developers may occur.

SUMMARY

According to a first aspect, there is provided an electrophotographic toner including a compound represented by formula (1) and a compound represented by formula (2).

Formula (1)

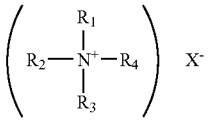

Formula (2)

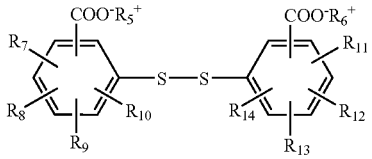

(In Formula (1), $R_1$, $R_2$, $R_3$, and $R_4$ each independently represent a hydrogen atom, an alkyl group or an aromatic group, and $X^-$ represents a molybdate anion or a tungstate anion. In Formula (2), $R_5^+$ and $R_6^+$ each independently represent a hydrogen ion, an ammonium ion, an iminium ion, or a phosphonium ion, and $R^7$, $R^8$, $R^9$, $R^{10}$, $R^{11}$, $R^{12}$, $R^{13}$, and $R^{14}$ each independently represent a hydrogen atom or an alkyl group.)

BRIEF DESCRIPTION OF THE DRAWING

Embodiments of the present invention will be described in detail based on the following FIGURE, wherein.

DETAILED DESCRIPTION

Figure 1:
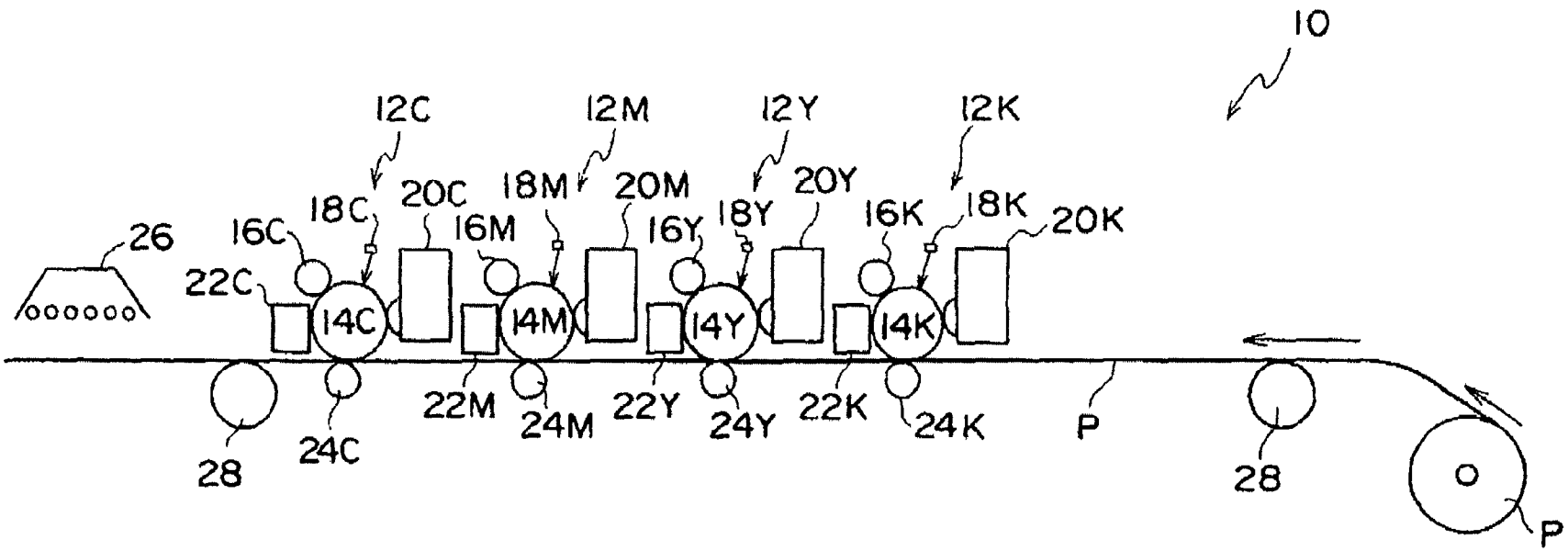
FIG. 1 is a schematic diagram showing an example of the image forming apparatus of the present invention.

The electrophotographic toner according to an aspect of the invention (hereinafter also simply referred to as "the toner according to an aspect of the invention"), which may be used as a two-component toner to be positively charged, may overcome the instability of latent images or a poor retention of surface potential even when an α-Si photoreceptor is used and may establish conditions under which the reproducibility of high-resolution dots, background fogging, and image uniformity are simultaneously satisfactory. The electrophotographic toner according to an aspect of the invention includes at least a binder resin, a compound represented by Formula (1), and a compound represented by Formula (2) below, respectively.

Formula (1)

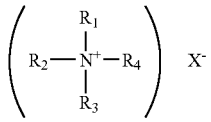

Formula (2)

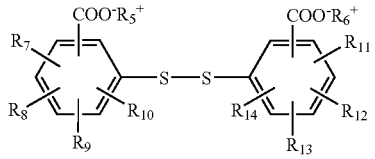

In Formula (1), $R_1$, $R_2$, $R_3$, and $R_4$ each independently represent a hydrogen atom, an alkyl group or an aromatic group, and $X^-$ represents a molybdate anion or a tungstate anion. The molybdate anion may be any of an orthomolybdate anion, a metamolybdate anion, or a paramolybdate anion. The tungstate anion may be any of an orthtungstate anion, a metatangustate anion, or a paratangustate anion. In Formula (2), $R_5^+$ and $R_6^+$ each independently represent a hydrogen ion, an ammonium ion, an iminium ion, or a phosphonium ion, and $R^7$, $R^8$, $R^9$, $R^{10}$, $R^{11}$, $R^{12}$, $R^{13}$, and $R^{14}$ each independently represent a hydrogen atom or an alkyl group.

The total content of the compounds represented by Formulae (1) and (2) in the toner according to an aspect of the invention is preferably from 0.3 to 5% by mass, more preferably from 0.5 to 3% by mass, still more preferably from 0.7 to 1% by mass, in terms of suppressing variations in charge amount caused by fluctuations in the amount of the toner in the developer.

In the toner according to an aspect of the invention, the ratio of the compound represented by Formula (1) to the compound represented by Formula (2) (the compound represented by Formula (1):the compound represented by Formula (2) in mass ratio) is preferably from 99:1 to 60:40, more preferably from 90:10 to 75:25, in terms of retaining a more preferred amount of charge.

The compound represented by Formula (1) will be first described. In Formula (1), when any of $R_1$, $R_2$, $R_3$, or $R_4$ represents an alkyl group, the alkyl group may be an alkyl group having 8 to 22 carbon atoms or an alkyl group having 1 to 4 carbon atoms. Specifically, the alkyl group having 8 to 22 carbon atoms is preferably a dodecyl group, a tetradecyl group, a hexadecyl group, or an octadecyl group, more preferably a tetradecyl group or a hexadecyl group. The alkyl group having 1 to 4 carbon atoms is preferably a methyl group or a butyl group, more preferably a methyl group.

In Formula (1), when any of $R_1$, $R_2$, $R_3$, or $R_4$ represents an aromatic group, the aromatic group is not particularly limited, and is preferably a five- to seven-membered ring group, more preferably a six-membered ring group. The aromatic group may contain a hetero atom such as nitrogen, oxygen or sulfur or may have a structure in which plural aromatic rings are condensed.

In the compound represented by Formula (1), it is preferable that each of $R_1$, $R_2$, $R_3$, and $R_4$ is an alkyl group or an aromatic group, and it is more preferable that two of $R_1$, $R_2$, $R_3$, and $R_4$ are alkyl groups having 8 to 22 carbon atoms, and the other two are alkyl groups having 1 to 4 carbon atoms.

In Formula (1), $X^-$ represents a molybdate anion or a tungstate anion, preferably a molybdate anion.

The compound represented by Formula (2) will be next described. In Formula (2), $R_5^+$ and $R_6^+$ each independently represent a hydrogen ion, an ammonium ion, an iminium ion, or a phosphonium ion, and $R^7$, $R^8$, $R_9$, $R_{10}$, $R^{11}$, $R^{12}$, $R^{13}$, and $R^{14}$ each independently represent a hydrogen atom or an alkyl group.

When any of $R_5^+$ or $R_6^+$ represents an ammonium ion, the ammonium ion may be an ion represented by Formula (3) below. When any of $R_5^+$ or $R_6^+$ represents an iminium ion, the iminium ion may be an ion represented by Formula (4) below. When any of $R_5^+$ or $R_6^+$ represents a phosphonium ion, the phosphonium ion may be an ion represented by Formula (5) below.

Formula (3)

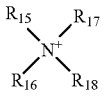

Formula (4)

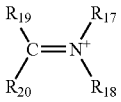

Formula (5)

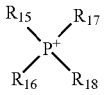

In Formulae (3) to (5), $R_{15}$, $R_{16}$, $R_{17}$, and $R_{18}$ each independently represent a hydrogen atom or a hydrocarbon-based residue optionally interrupted by a hetero atom. Examples of the hydrocarbon-based residue optionally interrupted by a hetero atom include a linear or branched alkyl group having 1 to 30 carbon atoms, preferably of 1 to 22 carbon atoms; an oxyethyl group represented by the formula —$CH_2$—$CH_2$—O)$_n$—R, wherein R represents a hydrogen atom, an alkyl group having 1 to 4 carbon atoms, or an acyl group such as acetyl, benzoyl or naphthoyl, and n is from 1 to 10, preferably from 1 to 4; a monocyclic or polycyclic cyclopentyl group; a monocyclic or polycyclic aromatic residue (such as phenyl, 1-naphthyl, 2-naphthyl, tolyl, or bisphenyl); and an aromatic-aliphatic residue (such as a benzyl residue), wherein the aliphatic group, the aromatic-aliphatic group, and the aromatic residue are each optionally substituted by a hydroxyl group, an alkyl group having 1 to 4 carbon atoms, an alkoxy group having 1 to 4 carbon atoms, a primary or secondary amino group (such as an N-monoalkyl (having 1 to 4 carbon atoms)-amino group or an N-dialkyl (each having 1 to 4 carbon atoms)-amino group), an acid amide group, particularly a phthalimide or naphthalimide group, or a fluorine, chlorine or bromine atom. In particular, the aliphatic residue is optionally substituted by 1 to 33 fluorine atoms.

$R_{19}$ and $R_{20}$ are each independently a hydrogen atom, a halogen atom, particularly a chlorine atom, or a hydrocarbon-based residue optionally interrupted by a hetero atom (such as an alkyl group (having 1 to 6 carbon atoms), an alkoxy group (having 1 to 6 carbon atoms), or an amino group represented by the formula —$NR_{21}R_{22}$, wherein $R_{21}$ and $R_{22}$ each independently represent a hydrogen atom or a hydrocarbon-based residue (particularly a $C_1$ to $C_6$ alkyl group). $R_{15}$ and $R_{17}$ or $R_{15}$ and $R_{19}$ may be coupled to each other to form a saturated or unsaturated, substituted or unsubstituted ring system of 5 to 7 carbon atoms which optionally contains a hetero atom (particularly a nitrogen atom and/or an oxygen atom and/or a sulfur atom). Examples of such a ring system include phenylene, naphthylene, pyridine, piperidine, and derivatives thereof While the carboxyl or carboxylate groups, namely —$COO^-R_5^+$ and —$COO^-R_6^+$, each may be at any position of the aromatic ring, they are preferably at the 2,2', 3,3' or 4,4' positions, respectively.

$R^7$, $R^8$, $R^9$, $R^{10}$, $R^{11}$, $R^{12}$, $R^{13}$, and $R^{14}$ each may be a hydrogen atom or a linear or branched, saturated or unsaturated alkyl group having 1 to 30 carbon atoms.

Examples of the main component of the binder resin in the toner according to an aspect of the invention include polyester resins, polyolefin resins, copolymers of styrene and acrylic or methacrylic acid, polyvinyl chloride resins, phenol resins, acrylic resins, methacrylic resins, polyvinyl acetate, silicone resins, polyester resins, polyurethane, polyamide resins, furan resins, epoxy resins, xylene resins, polyvinyl butyral, terpene resins, coumarone-indene resins, petroleum resins, and polyetherpolyol resins. One or more of these materials may be used alone or in any combination. In terms of durability or optical transparency, the binder resin is preferably a polyester resin or a norbornene-polyolefin resin, more preferably a polyester resin. The Tg (glass transition point) of each of these binder resins may be in the range of 50° C. to 70° C. The term "main component" means that the content thereof in the whole binder resin is 80% by mass or more.

As described above, the binder resin may comprise a polyester resin as a main component. It is preferable that a soft segment is not used as a raw material for the polyester resin. If a soft segment is added, the reaction rate at the polyester synthesis may be low so that unreacted materials or low molecular weight oligomers may be easily produced, which may cause a bad smell during flash fixing. The content of the soft segment in the whole monomers is preferably 2 mol % or less, and, more preferably, the soft segment is not added.

Examples of the soft segment include alkyl or alkenyl groups having 5 to 30 carbon atoms. Examples of soft segment-substituted aliphatic dicarboxylic acids include n-dodecenylsuccinic acid, n-dodecylsuccinic acid, isododecenylsuccinic acid, isododecylsuccinic acid, n-octenylsuccinic acid, and n-octylsuccinic acid. Examples of soft segment-substituted aliphatic diols include n-dodecenyl ethylene glycol and n-dodecenyl triethylene glycol.

In an aspect of the invention, the acid component for use in producing the polyester resin may be terephthalic acid, isophthalic acid, orthophthalic acid, or anhydride of any of the phthalic acids, and is preferably terephthalic acid/isophthalic acid. In order to crosslink the polyester, a trivalent or higher-valent carboxylic acid component may also be used as an additional acid component. Examples of the trivalent or higher-valent carboxylic acid component include 1,2,4-benzenetricarboxylic acid, 1,3,5-benzenetricarboxylic acid, other polycarboxylic acids, and anhydrides thereof.

In an aspect of the invention, the alcohol component for the polyester resin preferably includes 80 mol % or more of an alkylene oxide adduct of bisphenol A. The content of the alkylene oxide adduct of bisphenol A is more preferably 90 mol % or more, still more preferably at least 95 mol %. If the content of the alkylene oxide adduct of bisphenol A is less than 80 mol %, relative amounts of monomers that may cause a bad smell are large in some cases.

Examples of the alkylene oxide adduct of bisphenol A include the compounds represented by Formula (6):

Formula (6)

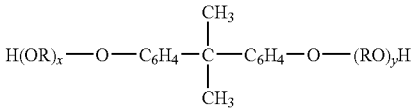

In Formula (6), R represents an ethylene or propylene group, and x and y each independently represent an integer of 1 or greater (preferably an integer of 1 to 10). Examples of the compounds represented by Formula (6) include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.2)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane. Preferred among them are polyoxypropylene(2.2)-2,2-bis(4-hydroxyphenyl)propane, polyoxyethylene(2.2)-2,2-bis(4-hydroxyphenyl)propane, and polyoxyethylene(2.0)-2,2-bis(4-hydroxyphenyl)propane. One or more of these materials may be used alone or in any combination.

In the case where flash fixing is used for fixation as described later, the compound represented by Formula (6) in which each of x and y is 1 and R is an ethylene group preferably makes up 60 mol % or more, more preferably 80 mol % or more of the alcohol components for the polyester. This is because the compound in which x and y are 1 and R is an ethylene group is most reactive among the compounds described above as examples, so that the amounts of remaining monomers, dimers or trimers in the polyester may be reduced.

Examples of tri- or higher-hydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and other tri- or higher-hydric alcohols.

In order to accelerate the reaction in the reaction process, any commonly used esterification catalyst may be used, such as zinc oxide, stannous oxide, dibutyltin oxide, and dibutyltin dilaurate.

The method for reducing remaining monomers, dimers or trimers in the polyester may be, for example, (1) increasing the amount of the reaction accelerator or (2) washing the resultant polyester with alcohol. An alcohol such as ethanol, methanol or isopropyl alcohol does not dissolve a high molecular weight polyester but dissolves monomers and dimers. Thus, dimers may be significantly reduced by washing with alcohol.

In addition, the polyester may be used in combination with a styrene-acrylic or methacrylic copolymer, polyvinyl chloride, a phenol resin, an acrylic resin, a methacrylic resin, polyvinyl acetate, a silicone resin, a polyester resin, polyurethane, a polyamide resin, a furan resin, an epoxy resin, a xylene resin, polyvinyl butyral, a terpene resin, a coumarone-indene resin, a petroleum resin, or a polyetherpolyol resin.

In the case of the cyan toner according to an aspect of the invention, examples of usable colorants include cyan pigments such as C.I. Pigment Blue 1, 2, 3, 4, 5, 6, 7, 10, 11, 12, 13, 14, 15, 15:1, 15:2, 15:3, 15:4, 15:6, 16, 17, 23, 60, 65, 73, 83, and 180, C.I. Vat Cyan 1, 3 and 20, iron blue, cobalt blue, alkali blue lake, phthalocyanine blue, metal-free phthalocyanine blue, partially chlorinated products of phthalocyanine blue, Fast Sky Blue, and Indanthrene Blue BC, and cyan dyes such as C.I. Solvent Cyan 79 and 162. Among them, C.I. Pigment Blue 15:3 is preferred.

In the case of the magenta toner according to an aspect of the invention, examples of usable colorants include magenta pigments such as C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 184, 202, 206, 207, and 209, and Pigment Violet 19, and magenta dyes such as C.I. Solvent Red 1, 3, 8, 23, 24, 25, 27, 30, 49, 81, 82, 83, 84, 100, 109, and 121, C.I. Disperse Red 9, and C.I. Basic Red 1, 2, 9, 12, 13, 14, 15, 17, 18, 22, 23, 24, 27, 29, 32, 34, 35, 36, 37, 38, 39, and 40, iron oxide red, cadmium red, red lead, mercury sulfide, cadmium, Permanent Red 4R, lithol red, pyrazolone red, Watching Red, calcium salts, Lake Red D, brilliant carmine 6B, eosin lake, rhodamine lake B, alizarin lake, and brilliant carmine 3B.

In the case of the yellow toner according to an aspect of the invention, examples of usable colorants include yellow pigments such as C.I. Pigment Yellow 2, 3, 15, 16, 17, 97, 180, 185, and 139.

In the case of the black toner according to an aspect of the invention, examples of usable colorants include carbon black, activated carbon, titanium black, magnetic powder, and Mn-containing nonmagnetic powder. Alternatively, yellow, magenta, cyan, red, green, and blue pigments may be mixed to form a pigment black toner.

The toner according to an aspect of the invention may contain a release agent. Examples of such a release agent include ester wax, polyethylene, polypropylene or copolymers of polyethylene and polypropylene, polyglycerin wax, microcrystalline wax, paraffin wax, carnauba wax, sazole wax, montanate ester wax, deoxidized carnauba wax, unsaturated fatty acids such as palmitic acid, stearic acid, montanic acid, plandinic acid, eleostearic acid, and valinalic acid; saturated alcohols such as stearin alcohol, aralkyl alcohol, behenyl alcohol, carnaubil alcohol, ceryl alcohol, melissyl alcohol, and long-chain alkyl alcohols having a long-chain alkyl group; polhydric alcohols such as sorbitol; fatty acid amides such as linoleic acid amide, oleic acid amide and lauric acid amide; saturated fatty acid bisamides such as methylenebisstearic acid amide, ethylenebiscapric acid amide, ethylenebislauric acid amide, and hexamethylenebisstearic acid amide; unsaturated fatty acid amides such as ethylenebisoleic acid amide, hexamethylenebisoleic acid amide, N,N'-dioleyladipic acid amide, and N,N'-dioleylcebasic acid amide; aromatic bisamides such as m-xylenebisstearic acid amide and N,N'-distearylisophthalic acid amide; metal salts of fatty acids (generally so-called metal soaps) such as calcium stearate, calcium laurate, zinc stearate, and magnesium stearate; grafted waxes such as those prepared by grafting a vinyl-containing monomer such as styrene or acrylic acid onto aliphatic hydrocarbon wax; partially esterified products between a fatty acid and a polyhydric alcohol such as behenic acid monoglyceride; and methyl ester compounds having a hydroxyl group obtained by hydrogenating vegetable oil and fats. Among them, ester wax, polyethylene, polypropylene, or a copolymer of polyethylene and polypropylene is preferred.

The release agent to be added to the toner according to an aspect of the invention may be a wax material that shows an endothermic peak in the range of 50 to 90° C. in DSC measurement (differential scanning calorimetry). If the endothermic peak temperature is lower than 50° C., the toner blocking may occur. If the endothermic peak temperature is higher than 90° C., the release agent may not contribute to fixation. In view of measurement principle, the DSC measurement may be performed using a high-precision, inner-heat, input-compensation type differential scanning calorimeter.

The toner according to an aspect of the invention may include an infrared absorbing agent. If the infrared absorbing agent is contained, high flash fusability may be achieved when a toner image formed on a recording medium is fixed by flash fusing. If the toner according to an aspect of the invention is an invisible toner, the toner can be detected with infrared radiation owing to the infrared absorbing agent. In general, the addition of an infrared absorbing agent may degrade the chargeability. In the case of the toner according to an aspect of the invention, however, the effects according to an aspect of the invention may be obtained with the chargeability remaining good, because the toner according to an aspect of the invention includes the compound represented by Formula (1) and the compound represented by Formula (2).

Any known infrared absorbing agent may be used in an aspect of the invention. Examples thereof include cyanine compounds, merocyanine compounds, benzene-thiol-containing metal complexes, mercaptophenol-containing metal complexes, aromatic-diamine-containing metal complexes, diimmonium compounds, aminium compounds, nickel complex compounds, phthalocyanine compounds, anthraquinone compounds, and naphthalocyanine compounds.

Specific examples of the infrared absorbing agent include nickel metal-complex-containing infrared absorbing agents (trade name: SIR-130, SIR-132, manufactured by Mitsui Chemicals, Inc.), bis(dithiobenzyl)nickel (trade name: MIR-101, manufactured by Midori Kagaku Co., Ltd.), bis[1,2-bis (p-methoxyphenyl)-1,2-ethylenedithiolate]nickel (trade name: MIR-102, manufactured by Midori Kagaku Co., Ltd.), tetra-n-butylammoniumbis(cis-1,2-diphenyl-1,2-ethylenedithiolate)nickel (trade name: MIR-1011, manufactured by Midori Kagaku Co., Ltd.), tetra-n-butylammoniumbis[1,2-bis(p-methoxyphenyl)-1,2-ethylenedithiolate]nickel (trade name: MIR-1021, manufactured by Midori Kagaku Co., Ltd.), bis(4-tert-1,2-butyl-1,2-dithiophenolate)nickel-tetra-n-butylammonium (trade name: BBDT-NI, manufactured by Sumitomo Seika Chemicals Co., Ltd.), cyanine infrared absorbing agents (trade name: IRF-106, IRF-107, manufactured by Fuji Photo Film Co., Ltd.), cyanine infrared absorbing agents (trade name: YKR2900, manufactured by YAMAMOTO CHEMICALS Inc.), aminium, diiminium infrared absorbing agents (trade name: NIR-AM1, IM1, manufactured by Nagase Chemtech), iminium compounds (trade name: CIR-1080, CIR-1081, manufactured by JAPAN CARLIT CO., LTD.), aminium compounds (trade name: CIR-960, CIR-961, manufacture by JAPAN CARLIT CO., LTD.), anthraquinone compounds (trade name: IR-750, manufactured by Nippon Kayaku Co., Ltd.), aminium compounds (trade name: IRG-002, IRG-003, IRG-003K, manufactured by Nippon Kayaku Co., Ltd.), polymethine compounds (trade name: IR-820B, manufactured by Nippon Kayaku Co., Ltd.), diiminium compounds (trade name: IRG-022, IRG-023, manufactured by Nippon Kayaku Co., Ltd.), dianine compounds (trade name: CY-2, CY-4, CY-9, manufactured by Nippon Kayaku Co., Ltd.), soluble phthalocyanine (trade name: TX-305A, manufactured by NIPPON SHOKUBAI Co., Ltd.), naphthalocyanine (trade name: YKR5010, manufactured by YAMAMOTO CHEMICALS Inc., Sample 1 manufactured by Sanyo Color Works, LTD.), and inorganic materials (trade name: Ytterbium UU—HP, manufactured by Shin-Etsu Chemical Co., Ltd. and indium tin oxide manufactured by Sumitomo Metal Industries, Ltd.). In the case where flash fixing is performed, diiminium, aminium, naphthalocyanine, or cyanine is preferred in view of dispersibility in the binder resin. Among these materials, there are cases where cyanine reacts with the compound represented by Formula (1) or (2) to deteriorate its performance as an infrared absorbing agent.

A known calixarene, nigrosin dye, quaternary ammonium salt, amino group-containing polymer, metal-containing azo dye, salicylate complex compound, phenol compound, azo-chromium system, or azo-zinc system may be used as a charge control agent.

The toner according to an aspect of the invention may also contain a magnetic material such as iron powder, magnetite and ferrite to serve as a magnetic toner. Particularly in the case of a color toner, white magnetic powder may be used.

Methods for producing the toner according to an aspect of the invention will be described below. The toner according to an aspect of the invention may be produced by methods similar to known toner production methods such as grinding methods and polymerization methods. If a grinding method is used, for example, the toner according to an aspect of the invention may be produced as described below. First, the colorant and the binder resin and optionally a release agent composition, a charge control agent, an infrared absorbing agent or the like are mixed, and then the materials are melted and kneaded using a kneader, an extruder or the like. Thereafter, the product resulting from melting and kneading is coarsely ground and then finely ground using a jet mill or the like, and the powder is classified with a wind force classifier, resulting in toner particles with a desired particle size. If necessary, an external additive such as silica may be added to the toner particles. Thus, the toner according to an aspect of the invention is obtained.

If a polymerization method is used, a suspension polymerization method or an emulsion polymerization aggregation method may be used typically.

If a suspension polymerization method is used to produce the toner according to an aspect of the invention, for example, the toner according to an aspect of the invention may be prepared as described below. First, the colorant (and optionally the infrared absorbing agent) is mixed with a monomer such as styrene, butyl acrylate, or 2-ethylhexyl acrylate, a crosslinking agent such as divinylbenzene, a chain transfer agent such as dodecyl mercaptan, and a polymerization initiator, and optionally, a charge control agent and/or a release agent composition is further added, so that a monomer composition is prepared. Thereafter, the monomer composition is added to a water phase containing a suspension stabilizer such as tricalcium phosphate or polyvinyl alcohol and a surfactant. The mixture is formed into an emulsion using a rotor-stator emulsifier, a high-pressure emulsifier, an ultrasonic emulsifier, or the like, and then the monomer is polymerized by heating to form particles. After the polymerization is completed, the resultant particles are washed and dried, and an external additive is optionally added thereto, so that the toner according to an aspect of the invention is obtained.

By an emulsion polymerization aggregation method, for example, the toner according to an aspect of the invention may be prepared as described below. First, a monomer such as styrene, butyl acrylate, or 2-ethylhexyl acrylate is added to an aqueous solution of a water-soluble polymerization initiator such as potassium persulfate, and optionally a surfactant such as sodium dodecyl sulfate is further added. Under stirring, polymerization by heating is conducted so that resin particles are obtained. Thereafter, the colorant (and optionally the infrared absorbing agent) and optionally powder of a charge control agent, a release agent composition and the like is added to a suspension of the resin particles. The resin particles and the colorant powder, and the infrared absorbing agent powder and the like are allowed to cause hetero aggregation by controlling the pH of the suspension, agitation intensity, temperature, or the like, so that hetero-aggregates are obtained. The reaction system is further heated to a temperature equal to or higher than the glass transition temperature of the resin particles so that the hetero-aggregates are fused to form toner particles. The toner particles are then washed and dried, and an external additive is optionally added, so that the toner according to an aspect of the invention is obtained.

Alternatively, the toner according to an aspect of the invention may be prepared by an emulsion aggregation method. A description will be given of the preparation of the toner according to an aspect of the invention by an emulsion aggregation method using a polyester rein as the binder resin.

A process of preparing the toner by an emulsion aggregation method using the polyester resin includes the steps of: emulsifying the polyester resin to form emulsified particles (droplets) (emulsifying step); forming aggregates of the emulsified particles (droplets) (aggregation step); and thermally fusing the aggregates at a temperature equal to or higher than the melting point of the polyester resin (coalescing step). The aggregation step and the coalescing step may be replaced by the step of allowing the emulsified particles to aggregate at a temperature equal to or higher than the melting point of the polyester resin such that aggregation and coalescence occur at the same time (so called association step).

In the emulsifying step, the emulsified particles (droplets) of the polyester resin are formed by applying a shear force to a solution prepared by mixing an aqueous medium and a liquid mixture (polymer liquid) containing the polyester resin and optionally the colorant. By heating to a temperature equal to or higher than the melting point of the crystalline polyester in this process, the viscosity of the polymer liquid may be reduced so that emulsified particles may be formed.

A dispersing agent may also be used to stabilize the emulsified particles or increase the viscosity of the aqueous medium. Hereinafter, a dispersion of the emulsified particles is also referred to as "the dispersion of resin particles."

In the aggregation step, the resultant emulsified particles are heated to a temperature close to but lower than the melting point of the polyester resin so that the particles are allowed to aggregate to form aggregates. The formation of the aggregates of the emulsified particles is achieved by making the pH of the emulsion acidic under stirring. The pH is preferably from 2 to 5, more preferably from 2.5 to 4.

In the aggregation step, a flocculating agent may be used in order to form aggregates. The flocculating agent to be used may be prepared by dissolving, in the dispersion of resin particles, a surfactant having the opposite polarity to that of the surfactant used as the dispersing agent or a general inorganic metal compound or a polymer thereof. The metal for the inorganic metal salt may be selected from metal elements which belong to Group 2A, 3A, 4A, 5A, 6A, 7A, 8, 1B, 2B, or 3B of the periodic table (long-form) and which have a charge with a valence of 2 or more and which can be dissolved in the form of ions in the aggregation system for resin particles.

Examples of the inorganic metal salt include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide. In particular, aluminum salts and polymers thereof are preferred.

In the coalescing step, the pH of the suspension of the aggregates is set in the range of 5 to 10 under stirring in the same manner as in the aggregation step so that the aggregation process is stopped, and the aggregates are fused and coalesced by being heated to a temperature equal to or higher than the melting point of the polyester resin. A heating temperature equal to or higher than the melting point of the polyester resin may work well. The heating time may be such a time as to allow the coalescence to proceeds sufficiently, and may be from about 0.2 to 10 hours.

The association step, in which the aggregation and coalescence steps are simultaneously performed, includes: allowing the particles to grow by the control of pH or the addition of the flocculating agent similarly to the aggregation step, under heating at a temperature equal to or higher than the melting point of the polyester resin; and lowering the temperature at a rate of at least 1° C./minute to a temperature equal to or lower than the crystallization temperature of the polyester resin similarly to the coalescing step when the particle size becomes the desired size, so that the particle growth is stopped simultaneously with the crystallization. The pH may also be adjusted before or after the temperature falling.

External additives such as white inorganic particles may further be externally added to the toner according to an aspect of the invention in order to increase the fluidity, the amount of the external additive added to the toner particles is preferably from 0.01 to 5 parts, more preferably from 0.01 to 2.0 parts, based on 100 parts of the toner particles before the external addition. Examples of such an external additive include silica powder, alumina, titanium oxide, barium titanate, magnesium titanate, calcium titanate, strontium titanate, zinc oxide, quartz sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. Silica powder is preferred. Known materials such as silica, titanium, resin particles, and alumina may also be used in combination. In addition, a metal salt of a higher fatty acid, such as zinc stearate or particle powder of fluoropolymer may be added as a cleaning active agent.

The external additive, and optionally, desired additives may be sufficiently mixed in a mixer such as a Henschel mixer when externally added.

A description will be given of the electrophotographic developer including the toner according to an aspect of the invention (hereinafter also abbreviated as "the developer"). The developer may be either a single-component developer comprising the toner according to an aspect of the invention or a two-component developer comprising a carrier and the toner according to an aspect of the invention. The case where the developer is a two-component developer is described in detail below.

Any known carrier may be used for the two-component developer without particular limitations. For example, the carrier may be a resin-coated carrier having a resin coating layer on the surface of a core material. Alternatively, the carrier may be a resin dispersion type carrier having an electrically-conductive material dispersed in a matrix resin.

The carrier for use in an aspect of the invention will be described below.

Ferrite, magnetite, iron powder, or the like may be used as a material of magnetic particles, which is the main body of the carrier (core material). In particular, manganese ferrite is advantageous in terms of providing long life because it has a strong magnetic force and is approximately in the shape of a true sphere. The manganese ferrite represented by Formula (I) below is more preferred.

$$(MnO)_x(Fe_2O_3)_y \quad (I)$$

wherein x and y each represent a molar ratio and satisfy the conditions: x+y=100 and x is in the range of 10 to 45.

If the molar ratio x of MnO is less than 10 mol %, the stability after the ferrite-forming reaction may be poor so that the resistance can be changed due to stress or the like and the developability can be degraded. If x is more than 45 mol %, the shape may be degraded, and the toner may adhere to the carrier surface in a developing machine due to stress or the like so that in some cases, variations in resistance may easily occur due to filming.

In a method of producing the manganese ferrite, the respective raw materials of metal oxide, metal carbonate, and metal hydroxide are blended in proper amounts, for example, in such a manner that the proportions of MnO and $Fe_2O_3$ are set to 20 mol % and 80 mol %, respectively, and water is added thereto. The materials are mixed and ground for 10 hours in a wet ball mill and dried and then kept at 950° C. for 4 hours. The product is pulverized in a wet ball mill for 24 hours so as to give a particle size of 5 μm or less. The resultant slurry is granulated and dried and kept at 1300° C. for 6 hours in a nitrogen atmosphere. The product is then cracked and classified to have a desired particle size distribution.

For example, a carrier for use in an aspect of the invention preferably has an average particle diameter of 30 to 90 μm, more preferably of 50 to 80 μm. If the average particle diameter is less than 30 μm, carrier adhesion may easily occur. If it is more than 90 μm, the image quality may be degraded. The carrier can be prepared by coating the core material with a resin in any known method such as a spray-drying method with a fluidized bed, a rotary drying method, or a dipping and drying method with a universal stirrer. In order to increase the carrier surface coverage, methods using a fluidized bed are recommended.

In the carrier for use in an aspect of the invention, various types of resins may be used for the coating of the core material surface. Examples of such resins include fluororesins, acrylic resins, epoxy resins, polyester resins, fluoro-acrylic resins, acrylic-styrene resins, silicone resins, modified silicone resins modified with an acrylic, polyester, epoxy, alkyd, or urethane resin, and crosslinked fluorine-modified silicone resins. Silicone resins and fluorine-modified silicone resins are preferred, and fluorine-modified silicone resins are more preferred. If necessary, a charge control agent, a resistance control agent or the like may also be added. Examples of the silicone resins include those having the repeating unit represented by Formula (II) or (III) below. The basic composition of these toners is as described above, and polyester, polystyrene, a styrene-acrylic copolymer, an epoxy resin, polyamide, poly(methyl methacrylate), or the like is generally used as the binder resin. In particular, polyester or a styrene-acrylic copolymer is typically used.

(II)

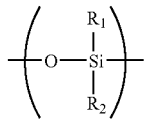

(III)

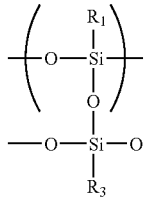

In Formulae (II) and (III), $R_1$, $R_2$ and $R_3$ each independently represent a hydrogen atom, a halogen atom, a hydroxyl group, a methoxy group, an alkyl group having 1 to 4 carbon atoms, or an organic group such as a phenyl group.

The two-component developer may be produced by mixing the toner and the carrier described above. In the developer, the mixing ratio (mass ratio) of the toner to the carrier (toner: carrier) is preferably in the range of 1:99 to 20:80, more preferably in the range of 3:97 to 12:88.

While the image forming apparatus using the developer containing the toner according to an aspect of the invention described above is not particularly limited as long as it uses a developer containing the toner according to an aspect of the invention to form a toner image on a recording medium, the image forming apparatus according to an aspect of the invention as described below may be used.

The full-color image forming apparatus according to an aspect of the invention includes: toner image-forming unit that forms a full-color toner image with toners including at least three color toners of a cyan toner, a magenta toner and a yellow toner; and fixing unit that fixes the toner image on a recording medium by flash fusing, wherein the toner includes at least a binder resin, the compound represented by Formula (1), the compound represented by Formula (2), and an infrared absorbing agent, and the apparatus has a process speed of 1000 mm/second or more. As used herein, the term "process speed" means the speed of conveyance of a recording medium in the process of forming an image on the recording medium such as a paper sheet. More specifically, such a process speed means, for example, that when 20 mm-long paper sheets are continuously output, 50 sheets or more are output per one second.

In an aspect of the invention, the light source for use in flash fusing (the fixing unit) may be a common halogen lamp, a mercury lamp, a flash lamp, an infrared laser, or the like. Instantaneous fixation with a flash lamp is most appropriate in view of energy saving. The emission energy of the flash lamp is preferably in the range of 1.0 to 7.0 J/cm$^2$, more preferably in the range of 2 to 5 J/cm$^2$.

The received light energy per unit area of flash light, which indicates the intensity of a xenon lamp, may be represented by Formula (7):

$$S=[((1/2)CV^2)/(uL)]\times(nf) \quad \text{Formula (7)}$$

n: the number of the lamps that emit light at a time f (Hz): emission frequency

V (V): input voltage

C (F): capacitor capacity u (cm/s): process conveyance speed

L (cm): effective emission width of flash lamp (generally maximum sheet width (cm))

S (J/cm$^2$): energy intensity

In an aspect of the invention, the mode of flash fusing may be a delay mode in which plural flash lamps are allowed to emit light at intervals. In the delay mode, plural flash lamps are arranged and allowed to emit light, respectively, at delay time intervals of about 0.01 to about 100 ms, so that the same place is irradiated plural times. In this mode, the light energy is not supplied to a toner image by a single emission but can be supplied in multiple portions so that fixing conditions may be mild and that anti-void performance and fixing performance may be satisfied at the same time.

When flash lighting is performed on the toner plural times, the emission energy of the flash lamp refers to the total amount of emission energy applied to the unit area per one emission.

In the invention, the number of the flash lamps is preferably from 1 to 20, more preferably from 2 to 10. The time interval between emissions from the respective flash lamps is preferably from 0.1 to 20 msec, more preferably from 1 to 3 msec.

The emission energy of a single flash lamp per one emission is preferably from 0.1 to 2.5 J/cm$^2$, more preferably from 0.4 to 2 J/cm$^2$.

If an invisible toner is used, the fixing unit is not limited to the flash fusing unit and may also be oven fixing unit, hot roll fixing unit or the like.

An example of the image forming apparatus according to an aspect of the invention is described below with reference to the drawing. FIG. 1 is a rough schematic diagram showing an example of the image forming apparatus according to an aspect of the invention.

The image forming apparatus 10 shown in FIG. 1 is configured to convey a recording medium P wound in the form of a roll by a paper conveying roller 28. At one side of the recording medium P conveyed in such a manner, four image forming units 12K, 12Y, 12M, and 12C (black (K), yellow (Y), magenta (M), and cyan (C)) are arranged in parallel from upstream to downstream in the conveying direction of the recording medium P; and a fixing unit 26 is placed downstream of the image forming units 12 (12K, 12Y, 12M, and 12C).

The black image forming unit 12K is a conventional electrophotographic image forming unit. Specifically, a charging unit 16K, exposure unit 18K, a developing unit 20K, and a cleaner 22K are placed around a photoreceptor 14K, and a transfer unit 24K is placed at the other side of the recording medium P. The other yellow, magenta and cyan image forming units 12Y, 12M and 12C are configured in a similar manner. The yellow image forming unit 12Y is a conventional electrophotographic image forming unit, and specifically, a charging unit 16Y, exposure unit 18Y, a developing unit 20Y, and a cleaner 22Y are placed around a photoreceptor 14Y, and a transfer unit 24Y is placed at the other side of the recording medium P. The magenta image forming unit 12M is a conventional electrophotographic image forming unit, and specifically, a charging unit 16M, exposure unit 18M, a developing unit 20M, and a cleaner 22M are placed around a photoreceptor 14M, and a transfer unit 24M is placed at the other side of the recording medium P. The cyan image forming unit 12C is a conventional electrophotographic image forming unit, and specifically, a charging unit 16C, exposure unit 18C, a developing unit 20C, and a cleaner 22C are placed around a photoreceptor 14C, and a transfer unit 24C is placed at the other side of the recording medium P.

The photoreceptor 14 (K, Y, M, C) to be used may generally be an inorganic photoreceptor such as amorphous silicon or selenium, or an organic photoreceptor such as polysilane or phthalocyanine. In terms of long life, an amorphous silicon photoreceptor is preferred.

A flash lamp such as a xenon lamp, a neon lamp, an argon lamp, and a krypton lamp may be used for the fixing unit 26. The energy for flash fusing may be set in the range of 1.0 to 7.0 J/cm$^2$, as described above.

In the image forming apparatus 10 shown in FIG. 1, toner images are sequentially transferred by the image forming units 12K, 12Y, 12M, and 12C, respectively, in a conventional electrophotographic manner onto the recording medium P supplied from the roll, and flash fusing is performed on the toner images by the fixing unit 26 so that an image is formed.

The most intense emission peak or the most sensitive range varies with the type of the light source for the flash fusing unit or the type of the sensor used for reading an invisible image such as an infrared absorbing pattern, and therefore the optimal light absorption properties required in the near infrared area may also vary depending on such factors. However, such light absorption properties in the near infrared area may be easily adjusted by controlling the molecular structure.

The image forming apparatus according to an aspect of the invention performs flash fusing and thus may manage high speed process. The process speed applied in the invention may be 1000 mm/second or more, preferably 1050 mm/second or more.

EXAMPLES

The present invention is specifically described below by means of examples, which are not intended to limit the scope of the invention. In the description below, "part or parts" means "part or parts by weight" in every case, unless otherwise stated. In the following description of Examples, the term "molybdate" refers to "metamolybdate".

Method for Measuring Particle Size

Concerning the invention, particle diameter (also referred to as "particle size") will be described.

In an aspect of the invention, when the particle diameter to be measured is 2 μm or more, MULTISIZER II (manufactured by Beckman Coulter, Inc.) is used as a measuring device, and ISOTON-II (manufactured by Beckman Coulter, Inc.) is used as an electrolyte.

In the measurement method, 2 mg of an analyte sample is added to 2 ml of an aqueous solution of 5% of a surfactant (serving as a dispersing agent), preferably sodium alkylbenzene sulfonate, and the mixture is added to 100 ml of the electrolyte.

The electrolyte solution containing the sample suspended therein is subjected to dispersing treatment for about one minute in an ultrasonic dispersion machine, and 50,000 particles in the particle size range of 2 to 40 μm are measured using an aperture with a diameter of 100 μm.

Concerning the particle diameter of the toner according to an aspect of the invention, the measured particle size distribution is divided into particle size ranges (channels), from which a volume cumulative distribution is created from the small particle size side, and the cumulative 50% volume particle diameter (named D50v) is defined as a volume average particle diameter.

Preparation of Compound A-1

In 95 of methanol, 9.5 parts of N,N-dimethyl-N,N-ditetradecylammonium chloride is dissolved and stirred. An aqueous solution of 9.2 parts of ammonium molybdate tetrahydrate in 60 parts of water is added dropwise thereto and stirred at 50° C. for two hours. The resultant white precipitate is separated by filtration, and the resultant white product is sufficiently washed with water and then dried to give 10 parts of a white crystal (named Compound A-1) with the following structure:

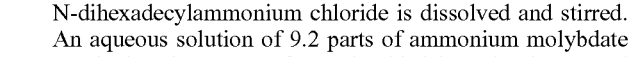

$(C_{14}H_{29})_2N^+(CH_3)_2.¼[Mo_8O_{26}]^{4-}$ Compound A-1

Preparation of Compound A-2

In 100 parts of methanol, 10.6 parts of N,N-dimethyl-N, N-dihexadecylammonium chloride is dissolved and stirred. An aqueous solution of 9.2 parts of ammonium molybdate tetrahydrate in 60 parts of water is added dropwise thereto and stirred at 50° C. for two hours. The resultant white precipitate is separated by filtration, and the resultant white product is sufficiently washed with water and then dried to give 10 parts of a white crystal (named Compound A-2) with the following structure:

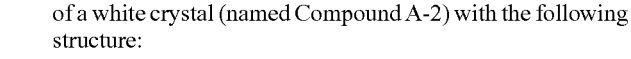

$(C_{16}H_{33})_2N^+(CH_3)_2.¼[Mo_8O_{26}]^{4-}$ Compound A-2

Preparation of Compound B-1

To 600 parts of ethanol, 30.6 parts of 2,2'-dithiobenzoic acid is added, and the mixture is stirred. Then, 36.5 parts of an aqueous solution of tetramethylammonium hydroxide at a concentration of 25% is added dropwise thereto at a temperature of 70 to 75° C. The resultant white precipitate is separated by filtration and dried and pulverized under an atmosphere at 120° C. to give 37.8 parts of a white powder (named Compound B-1, 2,2'-dithiodibenzoic acid-monotetramethylammonium salt).

Preparation of Compound B-2

To 600 parts of ethanol, 30.6 parts of 2,2'-dithiobenzoic acid is added, and the mixture is stirred. Then, 72.9 parts of an aqueous solution of tetramethylammonium hydroxide at a concentration of 25% is added dropwise thereto at a temperature of 70 to 75° C. The resultant white precipitate is separated by filtration and dried and pulverized under an atmosphere at 120° C. to give 45.2 parts of a white powder (named Compound B-2, 2,2'-dithiodibenzoic acid-ditetramethylammonium salt).

Preparation of Compound B-3

To 600 parts of ethanol, 30.6 parts of 2,2'-dithiobenzoic acid is added, and the mixture is stirred. Then, 36.8 parts of an aqueous solution of tetraethylammonium hydroxide at a concentration of 40% is added dropwise thereto at a temperature of 70 to 75° C. The resultant white precipitate is separated by filtration and dried and pulverized under an atmosphere at 120° C. to give 43.3 parts of a white powder (named Compound B-3, 2,2'-dithiodibenzoic acid-monotetraethylammonium salt).

Preparation of Compound B-4

To 600 parts of ethanol, 30.6 parts of 2,2'-dithiobenzoic acid is added, and the mixture is stirred. Then, 73.6 parts of an aqueous solution of tetraethylammonium hydroxide at a concentration of 40% is added dropwise thereto at a temperature of 70 to 75° C. The resultant white precipitate is separated by filtration and dried and pulverized under an atmosphere at 120° C. to give 56.3 parts of a white powder (named Compound B-4, 2,2'-dithiodibenzoic acid-ditetraethylammonium salt).

Preparation of Compound B-5

To 600 parts of ethanol, 30.6 parts of 2,2'-dithiobenzoic acid is added, and the mixture is stirred. Then, 101.7 parts of an aqueous solution of tetrapropylammonium hydroxide at a concentration of 20% is added dropwise thereto at a temperature of 70 to 75° C. The resultant white precipitate is separated by filtration and dried and pulverized under an atmosphere at 120° C. to give 56.3 parts of a white powder (named Compound B-5, 2,2'-dithiodibenzoic acid-monotetrapropylammonium salt).

Preparation of Compound B-6

To 600 parts of ethanol, 30.6 parts of 2,2'-dithiobenzoic acid is added, and the mixture is stirred. Then, 65 parts of an aqueous solution of tetrabutylammonium hydroxide at a concentration of 40% is added dropwise thereto at a temperature of 70 to 75° C. The resultant white precipitate is separated by filtration and dried and pulverized under an atmosphere at 120° C. to give 54.3 parts of a white powder (named Compound B-6, 2,2'-dithiodibenzoic acid-ditetrabutylammonium salt).

Example 1

A toner is prepared using Compounds A-1 and B-1 in such a manner that the total amount of Compounds A-1 and B-1 is one part based on 100 parts of the toner and the mass ratio of Compound A-1 to Compound B-1 (Compound A-1:Compound B-1) is 99:1.

Specifically, a toner composition including 84 parts of a polyester resin containing 5% by mass of a chloroform-insoluble matter (trade name: FN119, manufactured by Kao Corporation), 8 pars of a magenta pigment (trade name: ECR186Y, manufactured by Dainichiseika Color & Chemicals Mfg. Co., Ltd.), 5 parts of polypropylene (trade name: NP105, manufactured by Mitsui Chemicals, Inc.), one part in total of Compounds A-1 and B-1, and two parts of an infrared absorbing agent of diiminium (trade name: IRG023, manufactured by Nippon Kayaku Co., Ltd.) is added to a Henschel mixer and premixed. Thereafter, the mixture is kneaded in an extruder and then coarsely ground in a hammer mill and finely ground in a jet mill and classified in an air classifier to give magenta-colored particles with a volume-average particle diameter of 5.5 μm. One part of hydrophobic silica particles (trade name: H2000/4, manufactured by Clariant in Japan) is then added to the magenta-colored particles and subjected to external addition treatment in a Henschel mixer so that a magenta toner is obtained.

On the other hand, the surface of a ferrite core material is coated with a dimethyl silicone resin (trade name: SR2411, manufactured by Dow Coming Toray Co., Ltd.) to form a carrier with a volume-average particle diameter of 30 μm. Six parts by mass of the magenta toner is added to 94 parts by mass of the resultant carrier and mixed for two hours in a 10 L ball mill so that 700 parts of a two-component developer of Example 1 is prepared.

Example 2

A toner and a two-component developer of Example 2 are prepared using the same process as Example 1, except that Compounds A-1 and B-1 are used in such a manner that the mass ratio of Compound A-1 to Compound B-1 (Compound A-1:Compound B-1) is 75:25, while the total amount of Compounds A-1 and B-1 is one part based on 100 parts of the toner.

Example 3

A toner and a two-component developer of Example 3 are prepared using the same process as Example 1, except that Compounds A-1 and B-1 are used in such a manner that the mass ratio of Compound A-1 to Compound B-1 (Compound A-1:Compound B-1) is 60:40, while the total amount of Compounds A-1 and B-1 is one part based on 100 parts of the toner.

Example 4

A toner and a two-component developer of Example 4 are prepared using the same process as Example 1, except that Compounds A-1 and B-1 are used in such a manner that the mass ratio of Compound A-1 to Compound B-1 (Compound A-1:Compound B-1) is 50:50, while the total amount of Compounds A-1 and B-1 is one part based on 100 parts of the toner.

Example 5

A toner and a two-component developer of Example 5 are prepared using the same process of Example 1, except that Compounds A-1 and B-1 are used in such a manner that the total amount of Compounds A-1 and B-1 is 0.4 parts based on 100 parts of the toner and the mass ratio of Compound A-1 to Compound B-1 (Compound A-1:Compound B-1) is 75:25.

Example 6

A toner and a two-component developer of Example 6 are prepared using the sane process as Example 1, except that Compounds A-1 and B-1 are used in such a manner that the total amount of Compounds A-1 and B-1 (Compound A-1: Compound B-1) is 4 parts based on 100 parts of the toner and the mass ratio of Compound A-1 to Compound B-1 is 75:25.

Example 7

A toner and a two-component developer of Example 7 are prepared using the same process as Example 1, except that Compound A-1 is replaced by the same amount of Compound A-2 and Compound B-1 is replaced by the same amount of Compound B-2.

Example 8

A toner and a two-component developer of Example 8 are prepared using the same process as Example 7, except that Compound B-2 is replaced by the same amount of Compound B-3.

Example 9

A toner and a two-component developer of Example 9 are prepared using the same process as Example 7, except that Compound B-2 is replaced by the same amount of Compound B-4.

Example 10

A toner and a two-component developer of Example 10 are prepared using the same process as Example 7, except that Compound B-2 is replaced by the same amount of Compound B-5.

Example 11

A toner and a two-component developer of Example 11 are prepared using the same process as Example 7, except that Compound B-2 is replaced by the same amount of Compound B-6.

Example 12

A toner and a two-component developer of Example 12 are prepared using the same process as Example 1, except that Compounds A-1 and B-1 are used in such a manner that the total amount of Compounds A-1 and B-1 is 0.2 part based on 100 parts of the toner and the mass ratio of Compound A-1 to Compound B-1 (Compound A-1:Compound B-1) is 75:25.

Example 13

A toner and a two-component developer of Example 13 are prepared using the same process as Example 1, except that Compounds A-1 and B-1 are used in such a manner that the total amount of Compounds A-1 and B-1 is 8 parts based on 100 parts of the toner and the mass ratio of Compound A-1 to Compound B-1 (Compound A-1:Compound B-1) is 75:25.

Comparative Example 1

A toner and a two-component developer of Comparative Example 1 are prepared using the same process as Example 1, except that Compound B-1 is not used and one part of Compound A-1 is used based on 100 parts of the toner.

Comparative Example 2

A toner and a two-component developer of Comparative Example 2 are prepared using the same process as Example 1, except that Compound A-1 is not used and one part of Compound B-1 is used based on 100 parts of the toner.

Comparative Example 3

A toner and a two-component developer of Comparative Example 3 are prepared using the same process as Example 1, except that BONTRON N-04 (a resin acid-modified azine compound, manufactured by Orient Chemical Industries, Ltd.) and BONTRON S-32 (a metal-containing azo compound, manufactured by Orient Chemical Industries, Ltd.) are used in place of Compounds A-1 and B-1 in such a manner that the total amount of BONTRON N-04 and BONTRON S-32 is three parts based on 100 parts of the toner and the mass ratio of BONTRON N-04 to BONTRON S-32 is 5:1.

Evaluation

Using each of the developers obtained in Examples 1 to 13 and Comparative Examples 1 to 3, an evaluation is made of fine lines and small dots, background fogging and image quality over time, in an environment at 22° C. and 55% RH. The equipment used for the evaluation is a modified apparatus of DOCUPRINT 1100CF (manufactured by Fuji Xerox Co., Ltd.) equipped with a flash fusing unit having eight xenon flash lamps each having a high emission intensity in the wavelength range of 700 to 1500 nm (process speed: about 1400 mm/s). The method of flash emission is a delay emission method in which the emission is performed twice per unit area. In the delay emission, the same print surface is irradiated twice with light from four of the lamps emitting the same light energy with the delay time set to 0.5 msec. The results are shown in Tables 1 and 2.

Fine Lines and Small Dots

Images are formed using each developer under the above conditions, and fine lines and small dots are evaluated based on the following criteria:

A: an image quality level at which, in fine lines and dot patterns, no blurry portion or the like is found;

B: an image quality level at which, in fine lines and dot patterns, a thinner (smaller) portion is found with no broken portion, no dot missing portion or the like;

C: an image quality level at which, in fine lines and dot patterns, a thinner line portion is found or a dot missing portion is partially found, but the image quality is barely acceptable; and D: an image quality level at which, in fine lines and dot patterns, a broken line portion or a dot missing portion is found, and at which image quality defects occur.

Background Fogging

Images are formed using each developer under the above conditions, and background fogging is evaluated based on the following criteria:

A: a level at which there is absolutely no fogging;

B: a level at which there is slight fogging that is not visually recognizable;

C: a level at which weak fogging that is acceptable in terms of image quality is observed; and D: a level at which fogging is observed over the whole image, the fogging causing apparent defects in image quality.

Image Quality upon Passage of Time

Using each developer, 400,000 copies of an image are produced under the above conditions, and image quality upon passage of time is evaluated based on the following criteria:

A: a level at which fine lines and small dots and fogging are all at satisfactory levels;

B: a level at which at least one of fine lines and small dots or fogging is at the level B with no problem in image quality;

C: a level at which at least one of fine lines and small dots or fogging is at the level C while image quality is barely acceptable; and D: a level at which at least one of fine lines and small dots or fogging is at the D level so that there are image quality defects.

TABLE 1

| | | Example 1 | Example 2 | Example 3 | Example 4 | Example 5 | Example 6 | Example 7 | Example 8 | Example 9 | Example 10 |
|---|---|---|---|---|---|---|---|---|---|---|---|
| Type of the Compound Represented by Formula (1) (Content (parts) in 100 Parts of Toner) | | A-1 (0.99) | A-1 (0.75) | A-1 (0.60) | A-1 (0.50) | A-1 (0.30) | A-1 (3.00) | A-2 (0.99) | A-2 (0.99) | A-2 (0.99) | A-2 (0.99) |
| Type of the Compound Represented by Formula (2) (Content (parts) in 100 Parts of Toner) | | B-1 (0.01) | B-1 (0.25) | B-1 (0.40) | B-1 (0.50) | B-1 (0.10) | B-1 (1.00) | B-2 (0.01) | B-3 (0.01) | B-4 (0.01) | B-5 (0.01) |
| Evaluation Results | Fine Lines and Small Dots | A | B | B | C | B | B | A | A | A | B |
| | Background Fogging | B | A | A | B | A | B | B | B | B | B |
| | Image Quality Upon Passage Of Time | B | B | B | C | B | B | A | A | A | A |

TABLE 2

| | | Example 11 | Example 12 | Example 13 | Comparative Example 1 | Comparative Example 2 | Comparative Example 3 |
|---|---|---|---|---|---|---|---|
| Type of the Compound Represented by Formula (1) (Content (parts) in 100 Parts of Toner) | | A-2 (0.99) | A-1 (0.15) | A-1 (6.00) | A-1 (1.00) | — | — |
| Type of the Compound Represented by Formula (2) (Content (parts) in 100 Parts of Toner) | | B-6 (0.01) | B-1 (0.05) | B-1 (2.00) | — | B-1 (1.00) | — |
| Evaluation Results | Fine Lines and Small Dots | B | B | B | B | D | D |
| | Background Fogging | B | B | C | D | D | D |
| | Image Quality Upon Passage Of Time | A | C | B | D | B | D |

The results in Tables 1 and 2 show that the reproducibility of fine lines and small dots and background fogging are simultaneously at satisfactory levels with less deterioration in image quality over time in Examples 1 to 13 using a developer that contains the compound represented by Formula (1) and the compound represented by Formula (2).

A cyan toner-containing developer is prepared using the same process as Example 1, except that a cyan pigment (trade name: ECB-301, manufactured by Dainichiseika Color & Chemicals Mfg. Co., Ltd.) is used in place of the magenta pigment (trade name: ECR186Y, manufactured by Dainichiseika Color & Chemicals Mfg. Co., Ltd.). A yellow toner-containing developer is also prepared using the same process as Example 1, except that a yellow pigment (trade name: Toner Yellow HG, manufactured by Clariant) is used in place of the magenta pigment. A black toner-containing developer is further prepared using the same process as Example 1, except that a black toner for use in DOCUPRINT 1100 is used in place of the magenta toner.

The developer obtained in Example 1, the cyan toner-containing developer, the yellow toner-containing developer, and the black toner-containing developer are used in a ratio of six parts of each color toner to 94 parts of a carrier, and 1,000,000 copies of an image are produced in an environment at 22° C. and 55% RH in an experimental machine with the same structure as shown in FIG. 1. As a result, it is demonstrated that fine lines and small dots, background fogging, and image quality over time are evaluated as being at very good levels even after 1,000,000 copies of the image are produced. The experimental machine is equipped with a flash fusing unit (with a light energy of 3 to 7 J/cm$^2$ for fixing) having eight xenon flash lamps each having a high emission intensity in the wavelength range of 700 to 1500 nm. The method of flash emission is a delay emission method in which the emission is performed twice per unit area. In the delay emission, the same print surface is irradiated twice with light from four of the lamps emitting the same light energy with the delay time of 0.5 msec.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. An electrophotographic toner comprising a compound represented by Formula (1) and a compound represented by Formula (2):

Formula (1)

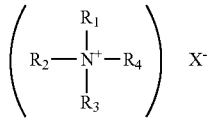

Formula (2)

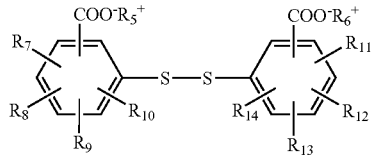

wherein, in Formula (1), $R_1$, $R_2$, $R_3$, and $R_4$ each independently represent a hydrogen atom, an alkyl group, or an aromatic group, and X represents a molybdate anion or a tungstate anion; and in Formula (2), $R_5^+$ and $R_6^+$ each independently represent a hydrogen ion, an ammonium ion, an iminium ion, or a phosphonium ion, and $R^7$, $R^8$, $R^9$, $R^{10}$, $R^{11}$, $R^{12}$, $R^{13}$, and $R^{14}$ each independently represent a hydrogen atom or an alkyl group; and wherein a mass ratio of the compound represented by Formula (1) to the compound represented by Formula (2) is from 99:1 to 60:40.

2. The electrophotographic toner of claim 1, further comprising an infrared absorbing agent.

3. The electrophotographic toner of claim 1, wherein a total content of the compounds represented by Formulae (1) and (2) in the toner is from about 0.3% by mass to 5% by mass.

4. The electrophotographic toner of claim 1, wherein at least one of $R_5^+$ or $R_6^+$ represents an ion represented by Formula (3):

Formula (3)

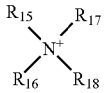

wherein, in Formula (3), $R_{15}$, $R_{16}$, $R_{17}$, and $R_{18}$ each independently represent a hydrogen atom, a hydrocarbon-based residue, or a hydrocarbon-based residue interrupted by a hetero atom.

5. The electrophotographic toner of claim 4, wherein at least one of $R_{15}$, $R_{16}$, $R_{17}$, or $R_{18}$ represents a linear or branched alkyl group having 1 to 30 carbon atoms, an oxyethyl group represented by the formula —($CH_2$—$CH_2$—O)$_n$—R, a monocyclic or polycyclic cyclopentyl group, a monocyclic or polycyclic aromatic residue, or an aromatic-aliphatic residue, wherein R represents a hydrogen atom, an alkyl group having 1 to 4 carbon atoms, or an acyl group, and n is an integer from 1 to 10.

6. The electrophotographic toner of claim 1, wherein at least one of $R_5^+$ or $R_6^+$ represents an ion represented by Formula (4):

Formula (4)

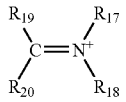

wherein, in Formula (4), $R_{17}$ and $R_{18}$ each independently represent a hydrogen atom, a hydrocarbon-based residue, or a hydrocarbon-based residue interrupted by a hetero atom; and $R_{19}$ and $R_{20}$ each independently represent a hydrogen atom, a halogen atom, a hydrocarbon-based residue, or a hydrocarbon-based residue interrupted by a hetero atom.

7. The electrophotographic toner of claim 6, wherein at least one of $R_{17}$ or $R_{18}$ represents a linear or branched alkyl group having 1to 30 carbon atoms, an oxyethyl group represented by the formula —$(CH_2—CH_2—O)_n$—R, a monocyclic or polycyclic cyclopentyl group, a monocyclic or polycyclic aromatic residue, or an aromatic-aliphatic residue, wherein R represents a hydrogen atom, an alkyl group having 1 to 4 carbon atoms, or an acyl group, and n is an integer from 1 to 10.

8. The electrophotographic toner of claim 7, wherein at least one of $R_{19}$ or $R_{20}$ represents an alkyl group having 1 to 6 carbon atoms, an alkoxy group having 1 to 6 carbon atoms, or an amino group represented by the formula —$NR_{21}R_{22}$, wherein $R_{21}$ and $R_{22}$ each independently represent a hydrogen atom or a hydrocarbon-based residue.

9. The electrophotographic toner of claim 1, wherein at least one of $R_5^+$ or $R_6^+$ represents an ion represented by Formula (5):

Formula (5)

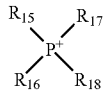

wherein, in Formula (5), $R_{15}$, $R_{16}$, $R_{17}$, and $R_{18}$ each independently represent a hydrogen atom, a hydrocarbon-based residue, or a hydrocarbon-based residue interrupted by a hetero atom.

10. The electrophotographic toner of claim 9, wherein at least one of $R_{15}$, $R_{16}$, $R_{17}$, or $R_{18}$ represents a linear or branched alkyl group having 1 to 30 carbon atoms, an oxyethyl group represented by the formula —$(CH_2—CH_2—O)_n$—R, a monocyclic or polycyclic cyclopentyl group, a monocyclic or polycyclic aromatic residue, or an aromatic-aliphatic residue, wherein R represents a hydrogen atom, an alkyl group having 1 to 4 carbon atoms, or an acyl group, and n is an integer from 1 to 10.

11. The electrophotographic toner of claim 1, further comprising a polyester resin.

12. The electrophotographic toner of claim 11, wherein an alcohol component for the polyester resin comprises about 80 mol% or more of an alkylene oxide adduct of bisphenol A.

13. The electrophotographic toner of claim 11, wherein the binder resin has a glass transition temperature of about 50 to 70° C.

14. The electrophotographic toner of claim 1, wherein the toner further comprises a release agent that shows an endothermic peak in the range of about 50 to 90° C. in DSC measurement (differential scanning calorimetry).

15. An electrophotographic developer comprising the toner of claim 1 and a carrier wherein the carrier is a manganese ferrite represented by Formula (I):

$$(MnO)_x(Fe_2O_3)_y \quad (I)$$

wherein x and y each represent a molar ratio and satisfy the conditions: x+y=100 and x is in the range of about 10 to 45.

16. The electrophotographic developer of claim 15, wherein an average particle diameter of the carrier is from about 30 to 90 μm.

17. The electrophotographic toner of claim 1, wherein the mass ratio of the compound represented by Formula (1) to the compound represented by Formula (2) is from 90:10 to 75:25.

18. An image forming apparatus for forming a full-color image, the apparatus comprising:

a toner image-forming unit that forms a full-color toner image with toners comprising three color toners of a cyan toner, a magenta toner and a yellow toner;

and a fixing unit that fixes the toner image on a recording medium by flash fusing, wherein the toner comprises a binder resin, a compound represented by Formula (1) below, a compound represented by Formula (2) below, and an infrared absorbing agent, the binder resin comprises a polyester resin as a main component, and the apparatus has a process speed of about 1000 mm/second or more:

Formula (1)

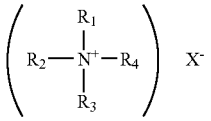

Formula (2)

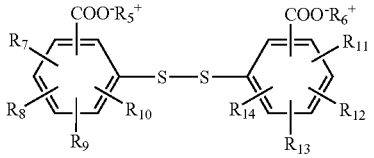

wherein, in Formula (1), $R_1$, $R_2$, $R_3$, and $R_4$ each independently represent a hydrogen atom, an alkyl group, or an aromatic group, and $X^-$ represents a molybdate anion or a tungstate anion; and in Formula (2), $R_5^+$ and $R_6^+$ each independently represent a hydrogen ion, an ammonium ion, an iminium ion, or a phosphonium ion, and $R_7$, $R_8$, $R_9$, $R_{10}$, $R_{11}$, $R_{12}$, $R_{13}$, and $R_{14}$ each independently represent a hydrogen atom or an alkyl group; and wherein a mass ratio of the compound represented by Formula (1) to the compound represented by Formula (2) is from 99:1 to 60:40.

19. The image forming apparatus of claim 18, wherein a light source for the flash fusing is a flash lamp, and an emission energy S of the flash lamp is in the range of about 1.0 to 7.0 J/cm$^2$.

* * * * *